US008863376B2

(12) United States Patent
Hirano et al.

(10) Patent No.: US 8,863,376 B2
(45) Date of Patent: Oct. 21, 2014

(54) CONNECTOR REMOVING JIG AND CONNECTOR REMOVING METHOD USING THE SAME

(75) Inventors: Masayoshi Hirano, Kawasaki (JP); Eiji Makabe, Kawasaki (JP); Takashi Imamoto, Kawasaki (JP); Hiroshi Satoh, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 833 days.

(21) Appl. No.: 13/093,051

(22) Filed: Apr. 25, 2011

(65) Prior Publication Data

US 2011/0197439 A1 Aug. 18, 2011

Related U.S. Application Data

(63) Continuation of application No. PCT/JP2008/069712, filed on Oct. 30, 2008.

(51) Int. Cl.

| | |
|---|---|
| ***H01R 9/00*** | (2006.01) |
| ***H01R 43/26*** | (2006.01) |
| ***H01R 13/633*** | (2006.01) |
| ***H01R 13/627*** | (2006.01) |

(52) U.S. Cl.

CPC ..... *H01R 13/6275* (2013.01); *H01R 43/26* (2013.01); *H01R 13/6335* (2013.01)

USPC ..... 29/842; 29/747; 29/825

(58) Field of Classification Search

CPC . H01R 43/26; H01R 13/6335; H01R 13/6275

USPC ..... 29/842, 747, 825

See application file for complete search history.

(56) References Cited

U.S. PATENT DOCUMENTS

| | | | |
|---|---|---|---|
| 4,582,352 | A | 4/1986 | Filter et al. |
| 5,210,934 | A | 5/1993 | Lenzi et al. |
| 2002/0019160 | A1 | 2/2002 | Takata |
| 2005/0255736 | A1 | 11/2005 | Szczesny |

FOREIGN PATENT DOCUMENTS

| | | | |
|---|---|---|---|
| JP | 52-87982 | | 6/1977 |
| JP | 54-63178 | | 5/1979 |
| JP | 61-56786 | | 4/1986 |
| JP | 62-65789 | | 4/1987 |
| JP | 11-40250 | | 2/1999 |
| JP | 11-40251 | | 2/1999 |
| JP | 2000354992 | A * | 12/2000 |

(Continued)

OTHER PUBLICATIONS

International Search Report mailed Nov. 25, 2008 for corresponding Japanese Patent Application No. PCT/JP2008/069712.

(Continued)

*Primary Examiner* — Carl Arbes

(74) *Attorney, Agent, or Firm* — Staas & Halsey LLP

(57) ABSTRACT

The removing jig includes a frame member and an arm member. The arm member includes a pair of side plates each provided with an axial hole. The arm member further includes an engagement portion that engages with the lever portion at its tip. The frame member includes a contact portion that contacts with a back surface of the connector body, a pair of side frame plates each provided with a guide groove formed with respect to the axial hole, and a first window portion from which the engagement portion protrudes.

9 Claims, 13 Drawing Sheets

(56) References Cited

FOREIGN PATENT DOCUMENTS

| | | |
|---|---|---|
| JP | 2002-56926 | 2/2002 |
| JP | 2002-151229 | 5/2002 |
| JP | 2004-39305 | 2/2004 |
| JP | 2006-228703 | 8/2006 |
| JP | 2008-117714 | 5/2008 |

OTHER PUBLICATIONS

European Search Report of European Application No. 08877735.4, dated Nov. 11, 2013.

* cited by examiner

CONNECTOR REMOVING JIG AND CONNECTOR REMOVING METHOD USING THE SAME

CROSS-REFERENCE TO RELATED APPLICATION

This application is a continuation application of PCT/JP2008/069712 filed Oct. 30, 2008, the contents of which are herein wholly incorporated by reference.

FIELD

An embodiment of present invention relates to a connector removing jig and a connector removing method using the same.

BACKGROUND

Recently, a number of connectors that connect cables may be densely-located in a vertical direction and in a horizontal direction in an electronic apparatus. This trend becomes more apparent due to the progress of downsizing of the electronic apparatus. When a number of connectors are densely-located, cables are closely spaced, and it becomes difficult to secure the space for the work of removing a connector. That is to say, in a case where the certain cable is removed, if a number of cables are densely-located in the vertical direction and in the horizontal direction and cables are closely spaced, the connector to be removed cannot be reached because other closely-spaced cables get in the way. Thus, to remove the certain cable, it is necessary to remove cables around the cable to be removed in sequence and to secure the space for the work so that the hands can reach the cable to be removed. As described above, the removal of extraneous cables for securing the space for the work is cumbersome itself, and has a risk of the misinsertion when returning cables to the original location.

In view of above circumstances, various types of extracting tools, devices and industrial tools have been conventionally suggested. For example, a device for inserting and extracting a connector, which includes a guide means that guides one connector to another connector and a connector move means that sends the one connector to the another connector via the guide means, is known.

[Patent-Document 1] Japanese Laid-open Patent Publication No. 2004-39305

SUMMARY

According to an aspect of the present invention, there is provided a removing jig that removes a cable connector which is connected to a substrate connector including a first connecting terminal, a first engaging catch portion and a second engaging catch portion. The cable connector includes a connector body to which a second connecting terminal which is connected to the first connecting terminal is provided on a front side, and a lever portion located at a back side of the connector body so as to be reciprocally movable in a removal direction from the substrate connector. In addition, the cable connector includes a first engagement nail and a second engagement nail that engage with a first engaging catch portion and a second engaging catch portion respectively in conjunction with the lever portion.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A description will now be given of an embodiment of the present invention with reference to accompanied drawings. In drawings, the size, the ratio and the like of each portion are not illustrated to correspond to actual portions completely. In addition, in several drawings, detail illustration may be omitted.

[Exemplary Embodiment]

Figure 7:
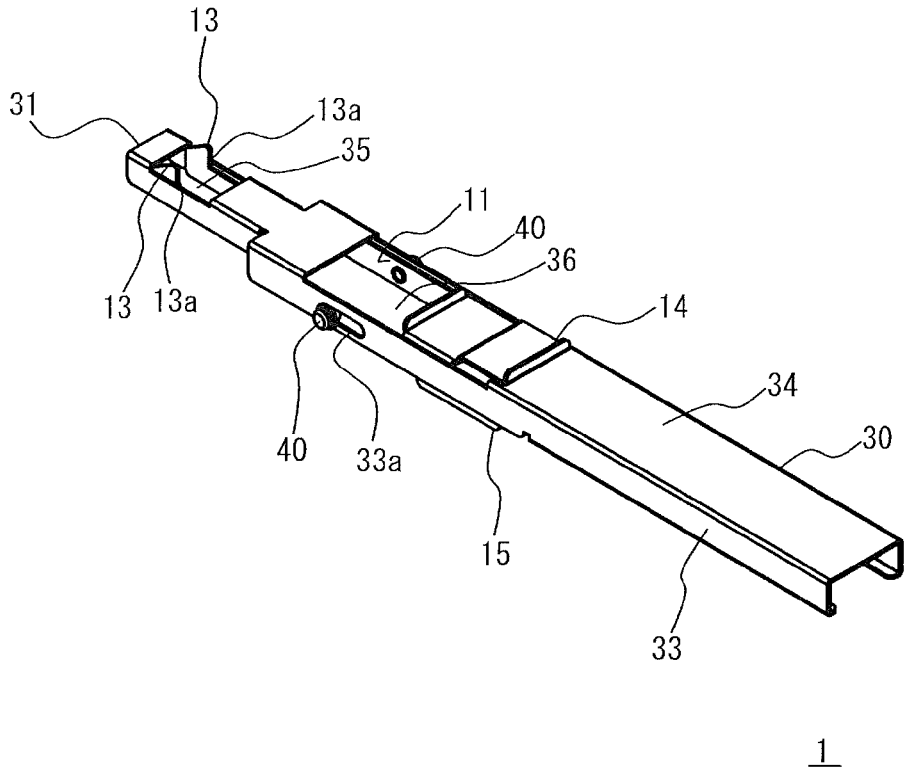
FIG. 7 is a perspective view of a removing jig.

Firstly, a description will be given of a cable connector 100 capable of being pulled out by a removing jig 1 to facilitate understanding of the removing jig 1 of the present embodiment described in FIG. 7 with reference to FIG. 1 through FIG. 5B.

Figure 1:
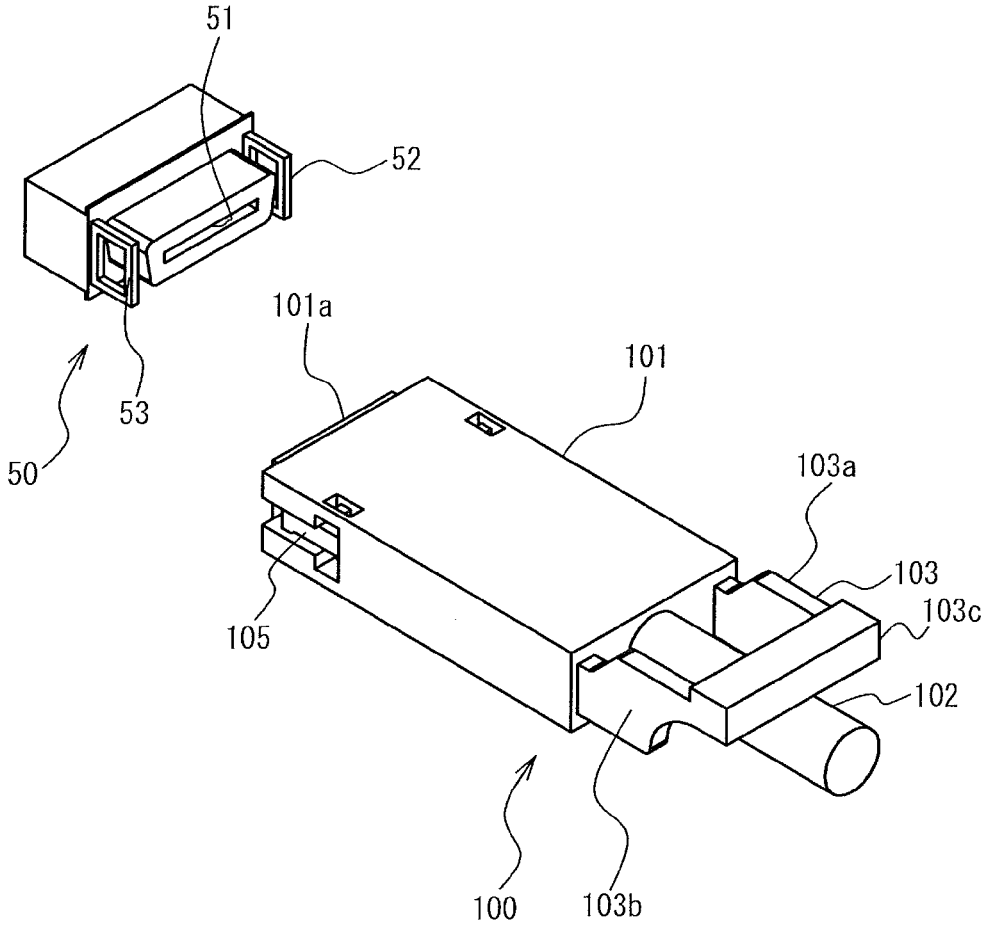
FIG. 1 is a perspective view of a substrate connector and a cable connector.
Figure 2:
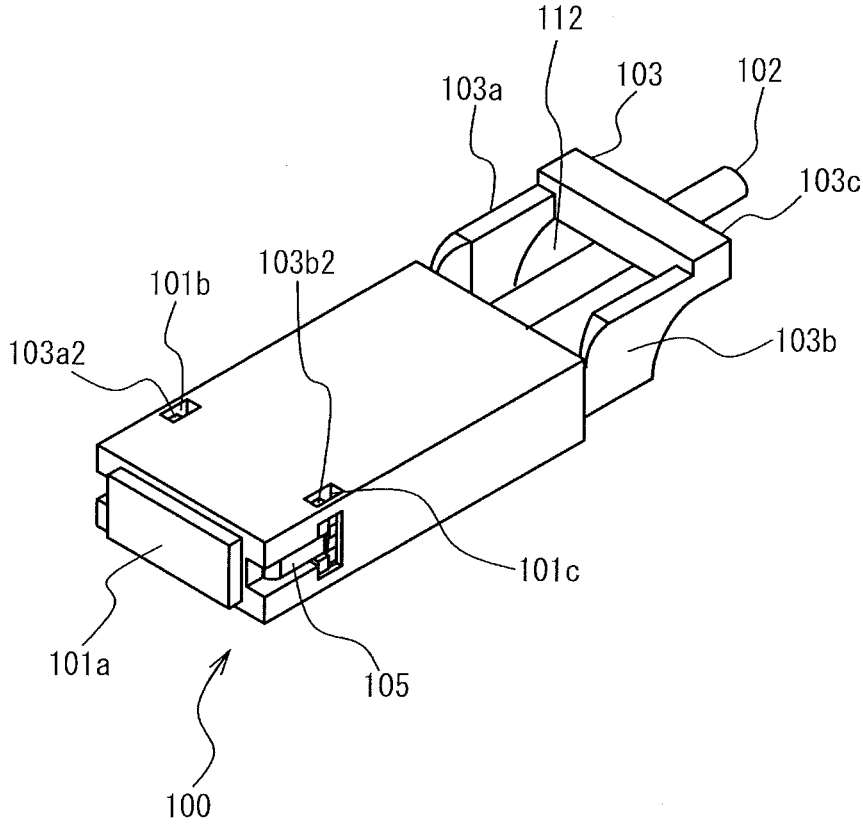
FIG. 2 is a perspective view of the cable connector.
Figure 3A:
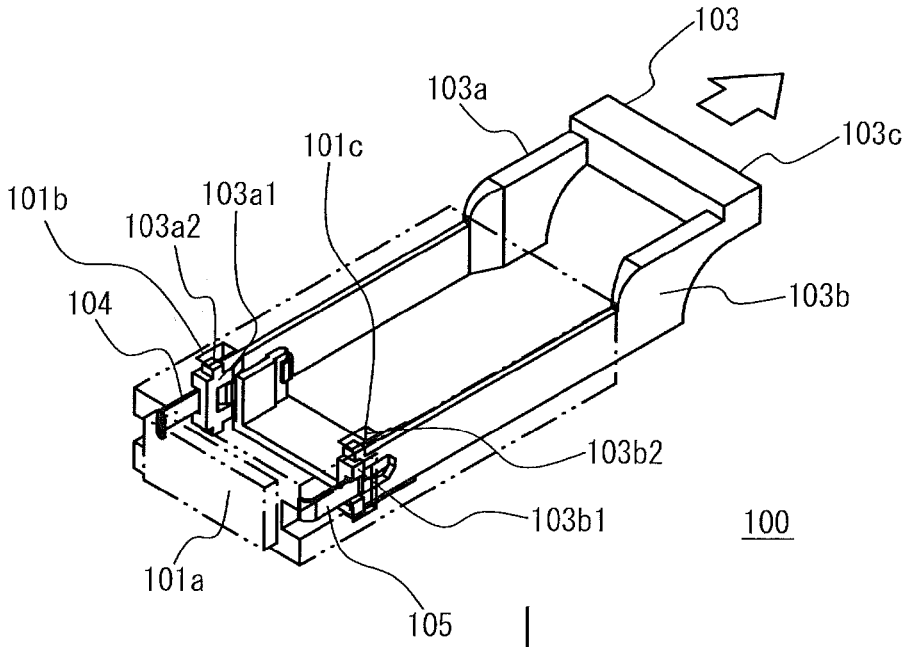
FIG. 3A and FIG. 3B are perspective views of the inside of the cable connector.
Figure 3B:
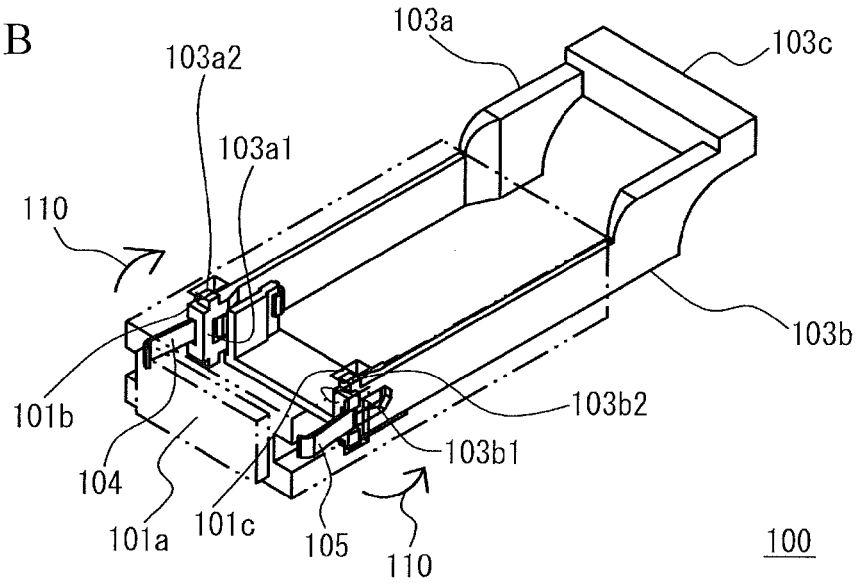
Figure 4A:
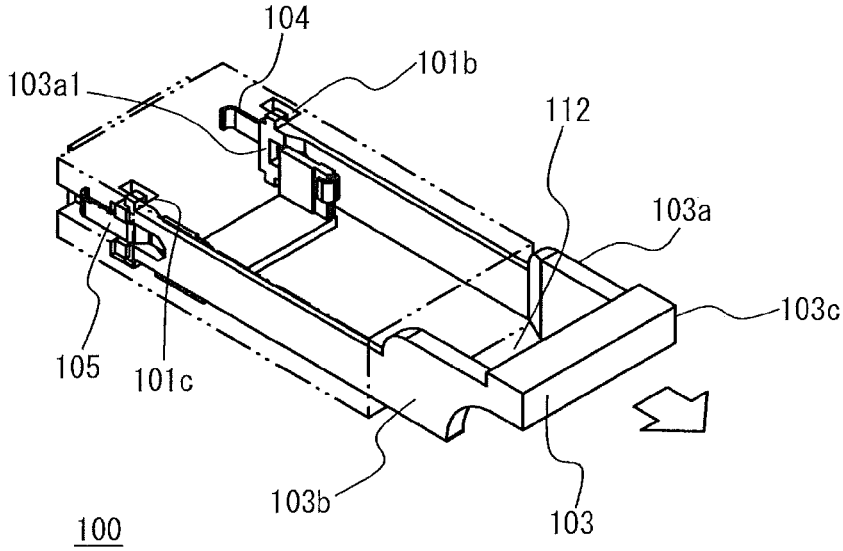
FIG. 4A and FIG. 4B are perspective views of the inside of the cable connector.
Figure 4B:
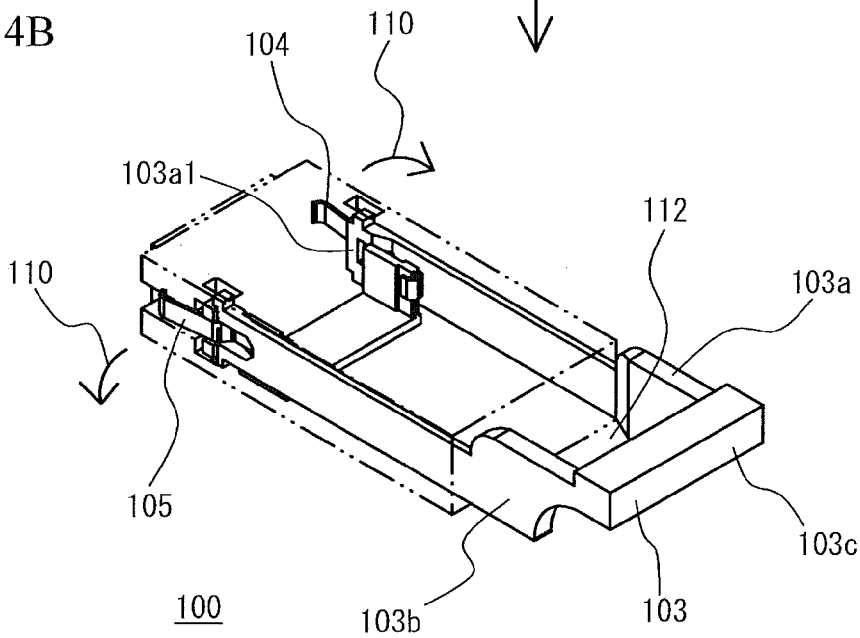

FIG. 1 is a perspective view of a substrate connector 50 and the cable connector 100. FIG. 2 is a perspective view of the cable connector 100 viewed from a different side from FIG. 1. FIGS. 3A and 3B are perspective views of the inside of the cable connector 100. FIG. 3A is a diagram illustrating a state where a first engagement nail 104 and a second engagement nail 105 are closed, and FIG. 3B is a diagram illustrating a state where the first engagement nail 104 and the second engagement nail 105 are opened. FIGS. 4A and 4B are perspective views of the inside of the cable connector 100 viewed from the different side from FIGS. 3A and 3B. FIG. 4A is a diagram illustrating a state where the first engagement nail 104 and the second engagement nail 105 are closed, and FIG. 4B is a diagram illustrating a state where the first engagement nail 104 and the second engagement nail 105 are opened.

The cable connector 100 is used by being coupled with the substrate connector 50 described in FIG. 1. The substrate connector 50 includes a first connecting terminal 51 on the side facing the cable connector 100. It also includes a first engaging catch portion 52 and second engaging catch portion 53, each of which has a rectangular frame, at the both sides of the first connecting terminal 51. On the other hand, the cable connector 100 includes a connector body 101 to which a second connecting terminal 101*a*, which is coupled with the first connecting terminal 51, is provided on the front side facing the substrate connector 50. The connector body 101 is formed as a casing. On the back side of the connector body 101, the lever portion 103 is located so as to be reciprocally movable in the removal direction from the substrate connector 50. The lever portion 103 includes a first leg portion 103*a* and a second leg portion 103*b* that extend to the removal direction from the substrate connector 50. The first leg portion 103*a* and the second leg portion 103*b* are coupled by the bridging portion 103*c* at their end portions. The first leg portion 103*a*, the second leg portion 103*b*, and the bridging portion 103*c* have a boxy shape when viewed from the back side. In addition, the first leg portion 103*a*, the second leg portion 103*b*, and the bridging portion 103*c* form a space 112 which houses an abutment portion 31 of a frame member 30 provided to the removing jig 1 described later.

The first leg portion 103*a* is extended so as to be slidably inserted into the connector body 101. A columnar guide portion 103*a*1 that the first engagement nail 104 described later contacts is provided at the tip portion of the first leg portion 103*a*. The guide portion 103*a*1 is offset slightly to the center side of the connector body 101.

In the same manner, the second leg portion 103*b* is extended so as to be inserted into the connector body 101 slidably. A columnar guide portion 103*b*1 that the second engagement nail 105 described later contacts is provided at a tip portion of the second leg portion 103*b*. The guide portion 103*b*1 is offset slightly to the center side of the connector body 101.

A first protrusion portion 103*a*2 is provided to the tip portion of the first leg portion 103*a*. In addition, a second protrusion portion 103*b*2 is provided to the tip portion of the second leg portion 103*b* in the same manner. The first protrusion portion 103*a*2 and the second protrusion portion 103*b*2 are located in a groove 101*b* and a groove 101*c* provided to the top panel of the connector body 101.

The connector body 101 described above includes a cable 102, and the cable 102 extends from the back side of the connector body 101.

The cable connector 100 further includes a first engagement nail 104 that engages with the first engaging catch portion 52 and a second engagement nail 105 that engages with the second engaging catch portion 53 in conjunction with the lever portion 103.

Figure 5A:
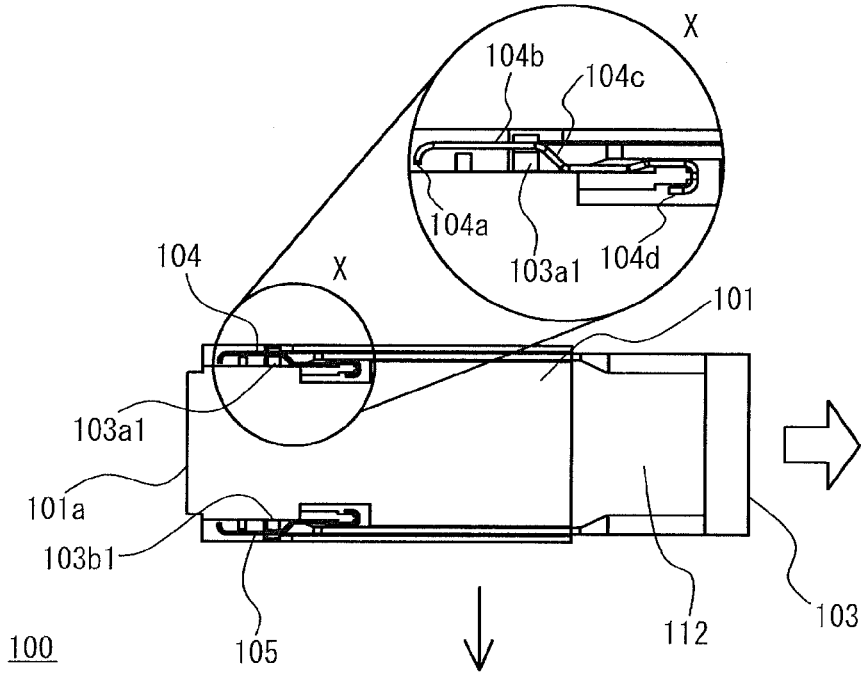
FIG. 5A and FIG. 5B are explanatory diagrams viewing an internal structure of the cable connector from a top.
Figure 5B:
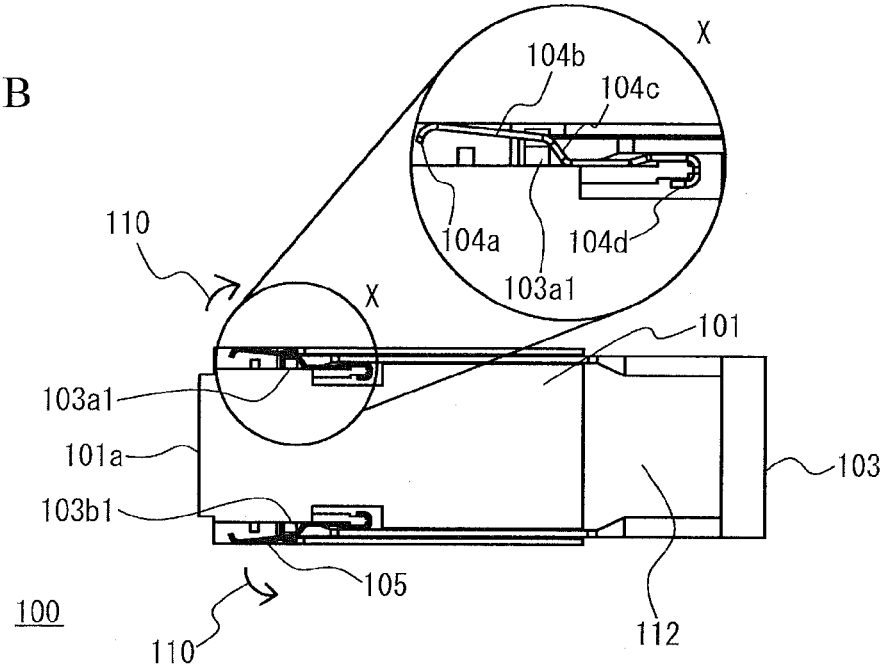

FIGS. 5A and 5B are explanatory diagrams of an internal structure of the cable connector 100 viewed from the top. FIG. 5A explains a state where the first engagement nail 104 and the second engagement nail 105 are in a closed state, and FIG. 5B explains a state where the first engagement nail 104 and the second engagement nail 105 are in an open state. In FIGS. 5A and 5B, the region around the first engagement nail 104 is defined as a region X, and the region X is enlarged and explained.

In the first engagement nail 104, an engagement portion 104*a* is curved at the tip portion. A straight portion 104*b* is connected to the engagement portion 104*a*, and a curved portion 104*c* is connected to the straight portion 104*b*. Furthermore, an attaching portion 104*d* is connected to the curved portion 104*c*. The first engagement nail 104 is installed with the attaching portion 104*d* being put into the connector body 101. According to this, the first engagement nail 104 is openable and closable around the attaching portion 104*d* as a fulcrum point. The first engagement nail 104 described above contacts the guide portion 103*a*1 provided to the leg portion 103*a* when being mounted to the connector body 101. As described in FIG. 5A, when the lever portion 103 is inserted and moved forward, and the guide portion 103*a*1 contacts the straight portion 104*b* of the first engagement nail 104, the first engagement nail 104 becomes closed. On the other hand, as described in FIG. 5B, when the lever portion 103 is extracted, and the guide portion 103*a*1 contacts the curved portion 104*c* of the first engagement nail 104, the first engagement nail 104 is pushed out by the guide portion 103*a*1, and becomes in an open state as illustrated with an arrow 110 in FIG. 4B and FIG. 5B.

The first engagement nail 104 and the second engagement nail 105 have the same structure. That is to say, as the guide portion 103*b*1 contacting the second engagement nail 105 moves back and forth, the opening and closing of the second engagement nail 105 around the attaching portion is achieved.

As described above, the first engagement nail 104 and the second engagement nail 105 engage with the first engaging catch portion 52 and the second engaging catch portion 53 so that they hook the first engaging catch portion 52 and the second engaging catch portion 53 from the outside when they becomes in a closed state. As described above, the cable connector 100 includes a locking mechanism with the substrate connector 50.

Figure 6:
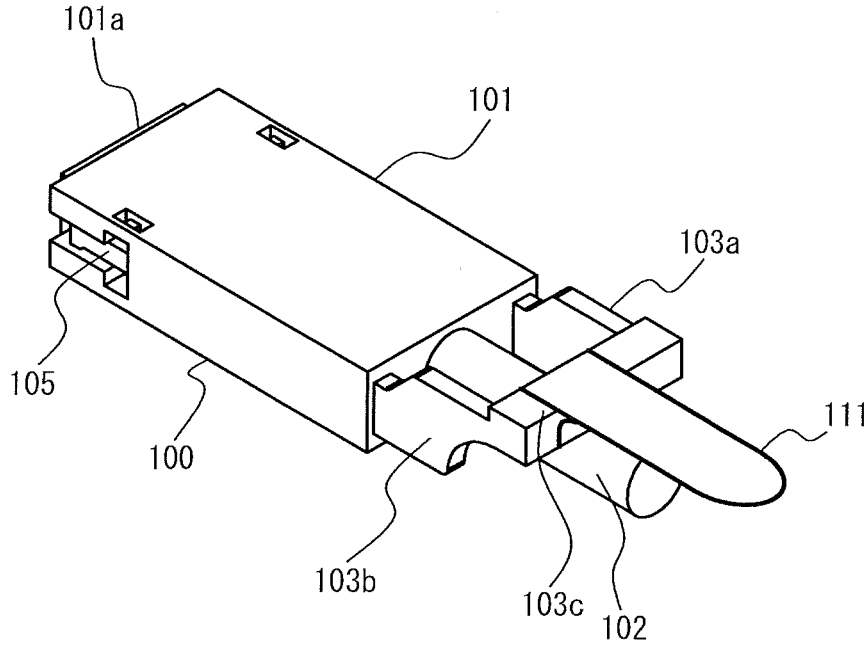
FIG. 6 is an explanatory diagram of an example using a tag for removing the cable connector.

If removing the cable connector 100 described above without using the removing jig 1 of the present embodiment, it is considered to use a tag 111 described in FIG. 6 for example. The tag 111 is a film tape and is used by being wrapped around the bridging portion 103*c*. If such tag 111 is pulled, the lever portion 103 can be extracted, and the cable connector 100 can be removed from the substrate connector 50.

However, when cables 102 are closely spaced, it is expected that a hand cannot reach the tag 111. In addition, it is cumbersome to wrap the tag 111 around each cable connector 100.

Figure 8:
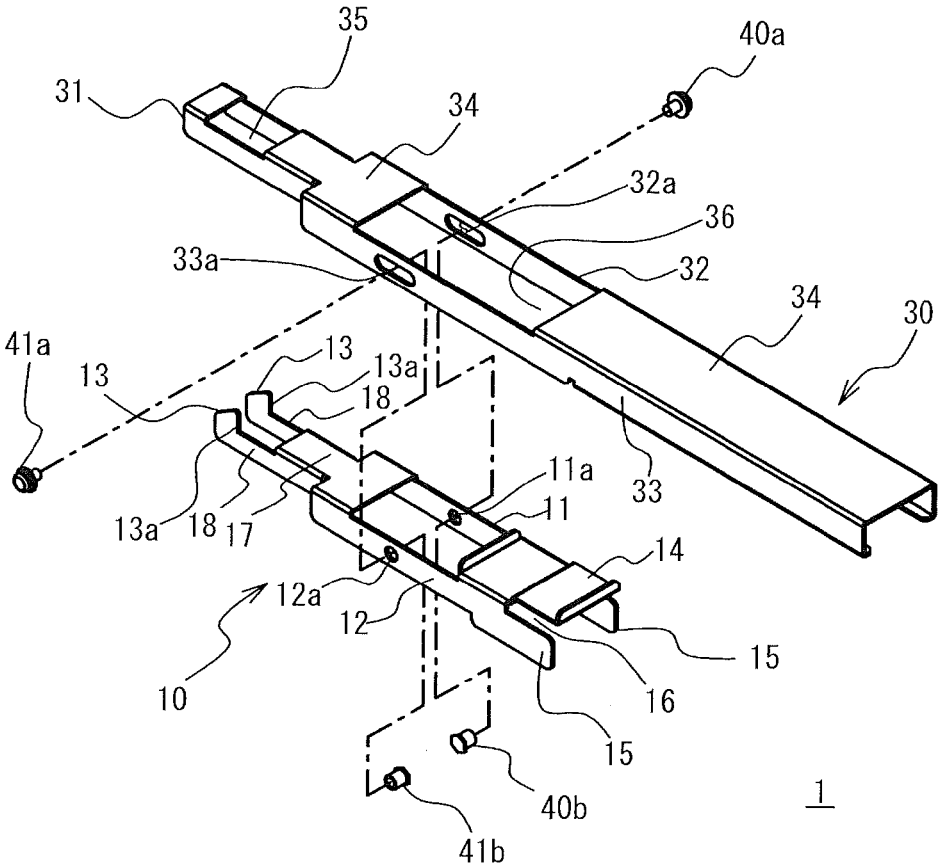
FIG. 8 is an exploded view of the removing jig.
Figure 9A:
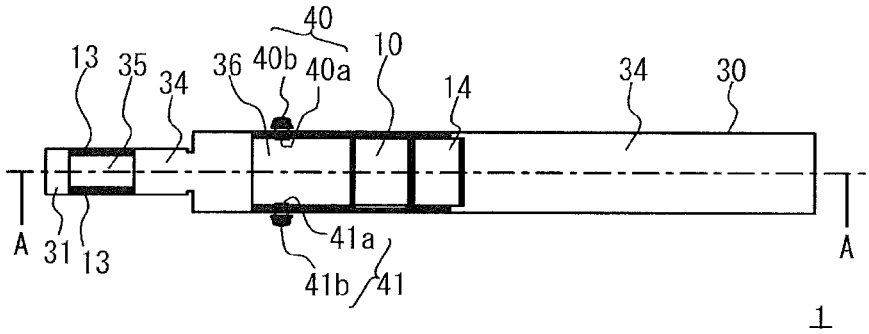
FIG. 9A is a plane view of the removing jig.
Figure 9B:
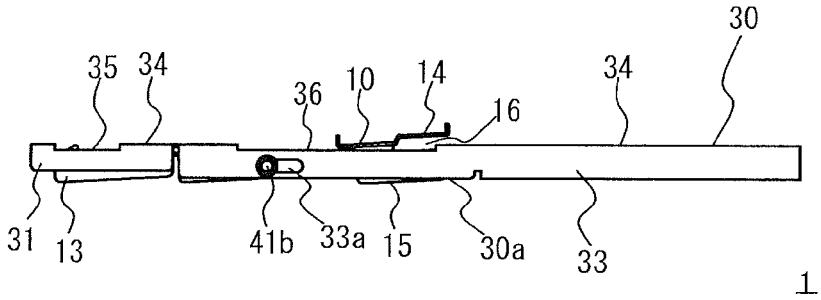
FIG. 9B is a side view of the removing jig.
Figure 9C:
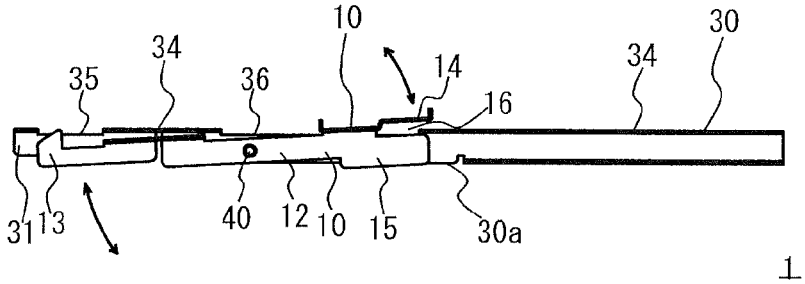
FIG. 9C is a cross-sectional diagram taken along the line A-A of FIG. 9A.

Thus, the removing jig 1 of the present embodiment is used. Hereinafter, a detail description will be given of the removing jig 1 with reference to FIG. 7 through FIG. 12C. FIG. 7 is a perspective view of the removing jig 1. FIG. 8 is an exploded view of the removing jig 1. FIG. 9A is a plane view of the removing jig 1, FIG. 9B is a side view of the removing jig 1, and FIG. 9C is a cross-sectional view taken along the line A-A of FIG. 9A.

The removing jig 1 is used when removing the cable connector 100 described above from the substrate connector 50. The removing jig 1 includes an arm member 10 and a frame member 30 as described in FIG. 8. Both of them are formed of a sheet metal. The removing jig 1 can be prepared at low cost by being formed of a sheet metal. In addition, a fabrication itself becomes easy.

The arm member 10 includes a first side plate 11 provided with the first axial hole 11*a* and a second side plate 12 placed opposite the first side plate 11 and provided with a second axial hole 12*a*. The first side plate 11 is connected to the second side plate 12 by the top plate 17. The top plate 17 is extended frontward, and extension plates 18, which are placed opposite each other with a clearance narrower than the clearance between the first side plate 11 and the second side plate 12, are provided on the underside of the top plate 17. An engagement portion 13 that is engaged with the bridging portion 103*c* of the lever portion 103 is provided at the tip portion of each extension plate 18. Each of engagement portions 13 has a claw-like shape, and is provided to the tip of each extension plate 18. The back end surface of the engagement portion 13 provided as described above becomes an abutment surface 13*a* with the bridging portion 103*c* of the lever portion 103. The engagement portion 13 can protrude from a first window portion 35 described later. In a state where the amount of protrusion from the first window portion 35 is large, the engagement portion 13 engages with the bridging portion 103*c*. The state where the amount of protrusion from the first window portion 35 is large corresponds to "a second state" in the present invention.

The arm member 10 includes a first arm operation portion 14 which is formed to have steps at its base end as described in FIG. 8 and FIG. 9A through FIG. 9C. The first arm operation portion 14 is located on the upper side of the first side plate 11 and the second side plate 12, and is provided so that a groove 16 is formed between the base end portion of the first side plate 11 and the base end portion of the second side plate 12. A top plate 34 of the frame member 30 described later is inserted into the groove 16. That is to say, the top plate 34 is sandwiched by the base end portion of the first side plate 11, the base end portion of the second side plate 12, and the first arm operation portion 14.

The tail end of the first arm operation portion 14 are bent upward, and is fabricated so as to be hooked by a finger of an operator easily when operated.

The arm member 10 further includes a second arm operation portion 15 that can protrude from a bottom edge 30*a* of the frame member 30 therebeneath as described in FIG. 8, FIG. 9B and FIG. 9C. The second arm operation portion 15 is located at the base end side of the arm member 10 in the same manner as the first arm operation portion 14. More specifically, it is formed by protruding the base end portion of the first side plate 11 and the base end portion of the second side plate 12 downward.

A description will now be given of the frame member 30. As described in FIG. 8, the frame member 30 includes an abutment portion 31 that abuts the back surface of the connector body 101 of the cable connector 100 at its tip side. In addition, it includes a first side plate 32 provided with a first guide groove 32*a* which is formed with respect to the first axial hole 11*a* provided to the first side plate 11 of the arm member 10. In addition, it includes a second side plate 33 provided with a second guide groove 33*a* which is formed with respect to the second axial hole 12*a* provided to the second side plate 12 of the arm member 10. Furthermore, the frame member 30 includes a top plate 34 connecting to the first side plate 32 and the second side plate 33. The first window portion 35 from which the engagement portion 13 provided to the arm member 10 protrudes is formed at the tip side in the top plate 34. In addition, a second window portion 36 from which the first arm operation portion 14 provided to the arm member 10 protrudes is located in the middle of the top plate 34.

As described in FIG. 8, the first guide groove 32*a* and the second guide groove 33*a* are formed as long grooves that extend in the removal direction from the substrate connector 100. The arm member 10 is reciprocally movable in a longer direction of the first guide groove 32*a* and the second guide groove 33*a* against the frame member 30.

The abutment portion 31 provided to the frame member 30 is formed narrower than the interval between the first side plate 32 and the second side plate 33. The abutment portion 31 is inserted into the space 112 of the cable connector 100 illustrated in FIG. 2 in a state where the amount of protrusion of the engagement portion 13 from the first window portion 35 is small. The space 112 is a space formed by being surrounded by the first leg portion 103*a*, the second leg portion 103*b* and the bridging portion 103*c*. It abuts the back surface of the connector body 101. As described in FIG. 9B and FIG. 9C, the state where the amount of protrusion of the engagement portion 13 from the first window portion 35 is small corresponds to a "first state" of the present invention.

The arm member 10 is located in the inside of the frame member 30 described above. As described in FIG. 9A, the arm member 10 and the frame member 30 are connected by the first connecting member 40 and the second connecting member 41. The arm member 10 can be connected swingably and slidably to the frame member 30 by using the first connecting member 40 and the second connecting member 41.

As described in FIG. 8, the first connecting member 40 includes a screw part 40*a* and a screw clamp part 40*b*. The second connecting member 41 includes a screw part 41*a* and a screw clamp part 41*b*. The screw clamp parts 40*b* and 41*b* have the same structure, and are cylindrical members where a screw is provided to the inside.

The screw clamp part 40*b* is inserted through the first axial hole 11*a* and the first guide groove 32*a*, and is screwed to the screw part 40*a*. Moreover, the screw clamp part 41*b* is inserted through the second axial hole 12*a* and the second guide groove 33*a*, and is screwed to the screw part 41*a*. According to this, the arm member 10 can be connected swingably and slidably to the frame member 30.

Figure 10A:
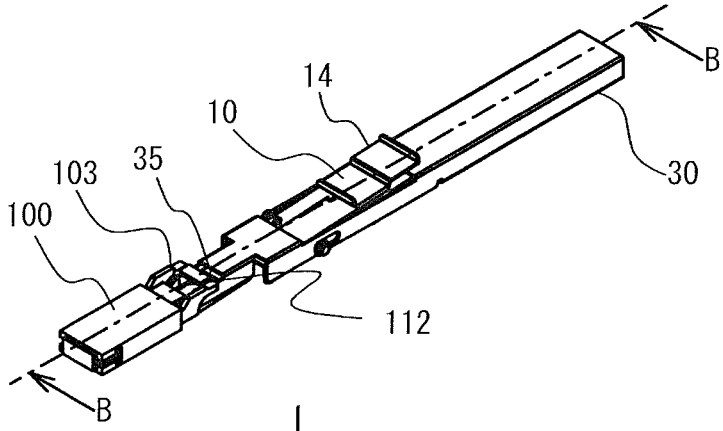
FIG. 10A through FIG. 10C are diagrams explaining steps of a connector removing method using the removing jig with perspective views.
Figure 10B:
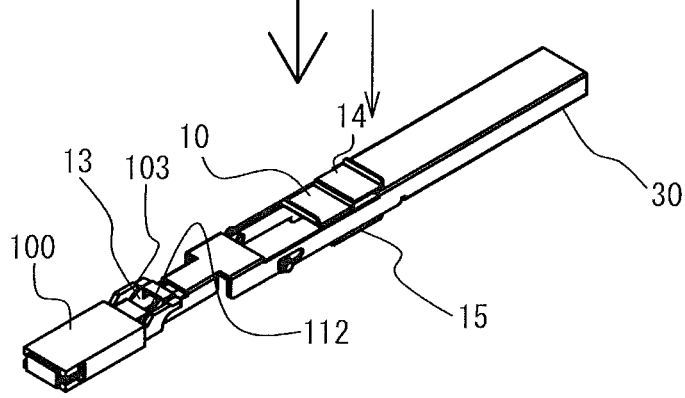
Figure 10C:
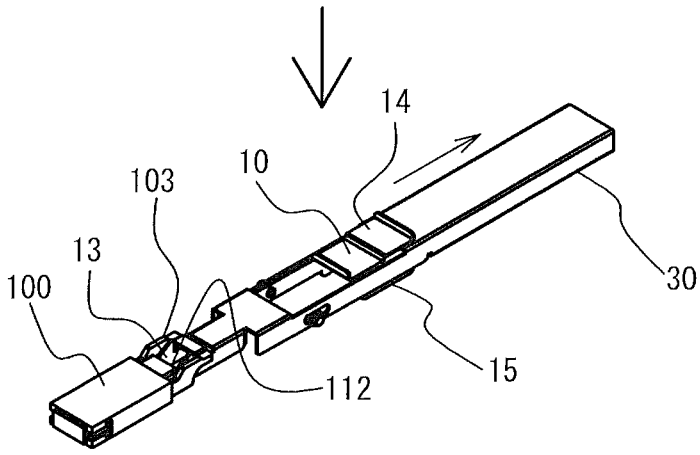
Figure 11A:
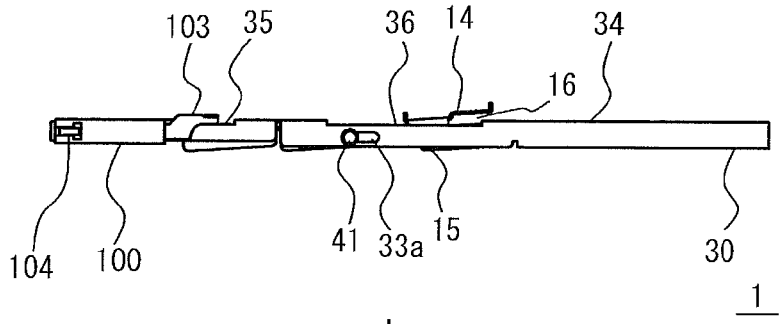
FIGS. 11A through 11C are diagrams explaining steps of a connector removing method using the removing jig 1 with a side view.
Figure 11B:
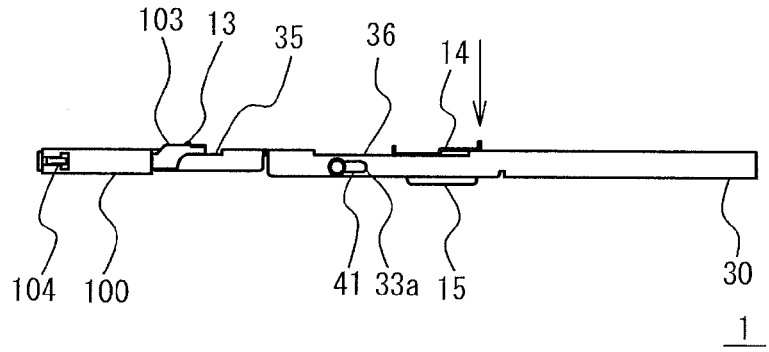
Figure 11C:
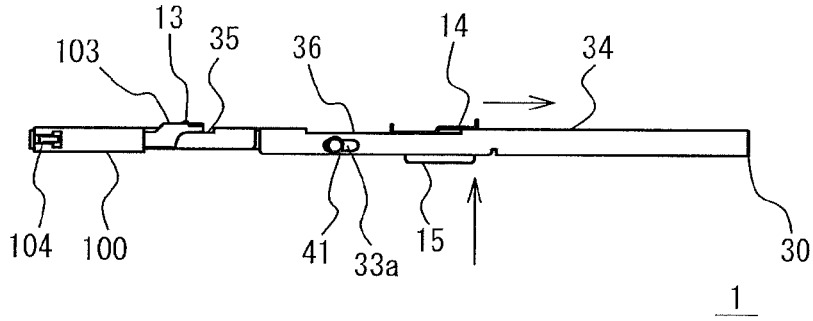
Figure 12A:
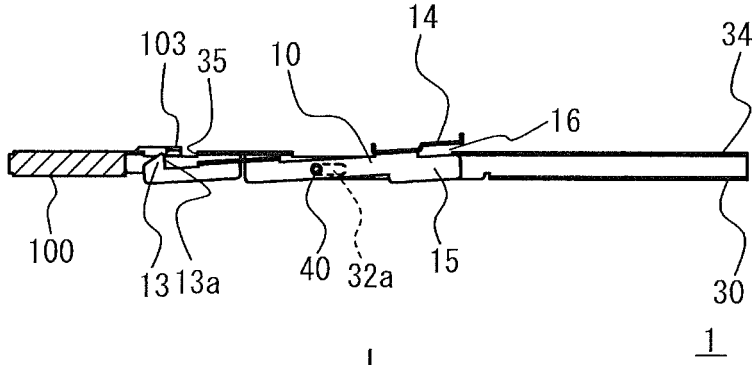
FIG. 12A through FIG. 12C are diagrams explaining steps of a connector removing method using the removing jig with cross-sectional views taken along the line B-B of FIG. 10A.
Figure 12B:
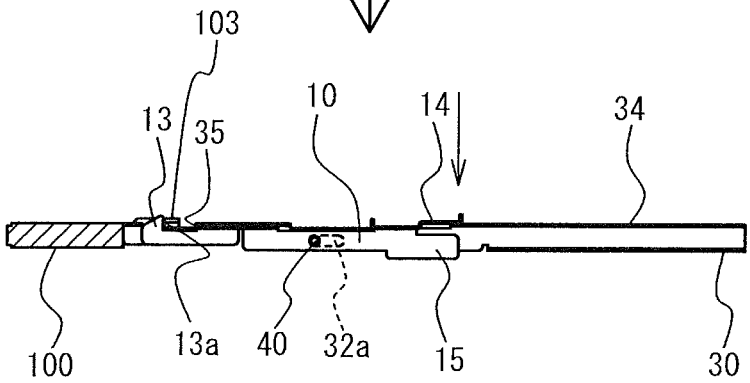
Figure 12C:
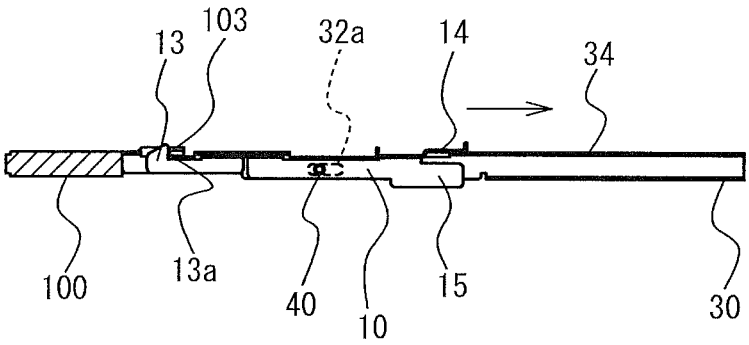

A description will now be given of a method for using the removing jig 1 described above, which means the pull-out of the cable connector 100 with the removing jig 1, with reference to FIG. 10A through FIG. 12C. FIGS. 10A through 10C are diagrams explaining steps of a connector removing method using the removing jig 1 with a perspective view. FIGS. 11A through 11C are diagrams explaining steps of a connector removing method using the removing jig 1 with a side view. FIGS. 12A through 12C are diagrams explaining steps of a connector removing method using the removing jig 1 with a cross-sectional view taken along the line B-B of FIG. 10A.

An operator puts his or her thumb to the first arm operation portion 14, grabs the base end of the frame member 30 of the removing jig 1 with putting long fingers on the second arm operation portion 15, and carries out an operation.

When removing the cable connector 100 from the substrate connector 50, the state of the engagement portion 13 is made the first state where the amount of protrusion from the first window portion 35 is small as described in FIG. 10A, FIG. 11A and FIG. 12A. To achieve this state, the first arm operation portion 14 may be lifted by a thumb, or the second arm operation portion 15 may be lifted by a forefinger or the like. This lowers the engagement portion 13 locating at the tip side of the arm member 10, and the amount of protrusion of the engagement portion 13 from the first window portion 35 becomes small. In this case, the arm member 10 is slid forward by pushing the first arm operation portion 14 forward by a thumb.

An operator moves the frame member 30 forward keeping the state of the engagement portion 13 the first state. Then, the abutment portion 31 located at the tip side of the frame member 30 is made to abut the back surface of the connector body 101. That is to say, the abutment portion 31 is inserted into the space 112 formed by being surrounded by the first leg portion 103*a*, the second leg portion 103*b* and the bridging portion 103*c* described in FIG. 2, and is made to abut the back surface of the connector body 101.

The arm member is made to swing in the condition where the abutment portion 31 is abutting the back surface of the connector body 101. That is to say, the first arm operation portion 14 is pushed downward as described in FIG. 10B, FIG. 11B, and FIG. 12B. This swings the arm member 10 around the first connecting member 40 and the second connecting member 41, which function as an axis member, and lifts the engagement portion 13. As a result, the state of the engagement portion 13 becomes the second state where the amount of protrusion from the first window portion 35 is large. The operator pulls the thumb toward the wrist from this state, and moves the first arm operation portion 14 backward slightly. This makes the abutment surface 13*a* of the engagement portion 13 abut the bridging portion 103*c*, and makes the engagement portion 13 engage with the lever portion 103.

Then, as described in FIG. 10C, FIG. 11C and FIG. 12C, the operator further pulls the thumb toward the wrist in the condition where the engagement portion 13 is engaged with the lever portion 103, and moves the arm member 10 backward against the frame member 30. The groove 16 is provided between the first arm operation portion 14 and the first side plate 11 and the second side plate 12 in the arm member 10, and the top plate 34 can be inserted into this groove 16. Thus, the arm member 10 can move backward against the frame member 30.

Due to the behavior of the arm member 10 described above, the lever portion 103 is extracted, the engagement between the first engagement nail 104 and the first engaging catch portion 52 is released, and the engagement between the second engagement nail 105 and the second engaging catch portion 53 is released. At this time, as the abutment portion 31 of the frame member 30 abuts the back surface of the connector body 101 and holds the connector body 101, only the lever portion 103 can be extracted.

In a state where the engagement between the first engagement nail 104 and the first engaging catch portion 52, and the engagement between the second engagement nail 105 and the second engaging catch portion 53 are released, the first protrusion portion 103*a*2 engages with the groove 101*b*. In addition, the second protrusion portion 103*b*2 engages with the groove 101*c*.

Next, the frame member 30 is moved backward in the condition where the engagement between the first engagement nail 104 and the first engaging catch portion 52 is released and the engagement between the second engagement nail 105 and the second engaging catch portion 53 is released. This releases the connection between the first connecting terminal 51 and the second connecting terminal 101*a*. A propagation of force of this moment will be described as follows. Firstly, the force pulling the engagement portion 13 is propagated to the lever portion 103 which is being engaged with the engagement portion 13. Then, the force is propagated to the connector body 101 from the lever portion 103, via the first protrusion portion 103*a*2 and the groove 101*b* that are engaged each other and the second protrusion portion 103*b*2 and the groove 101*c* that are engaged each other. This pulls the connector body 101, and releases the connection between the first connecting terminal 51 and the second connecting terminal 101*a*.

This completes the pull-out of the cable connector 100.

As described above, it is possible to remove the cable connector 100 from the substrate connector 50 with the removing jig 1 of the exemplary embodiment.

Figure 13:
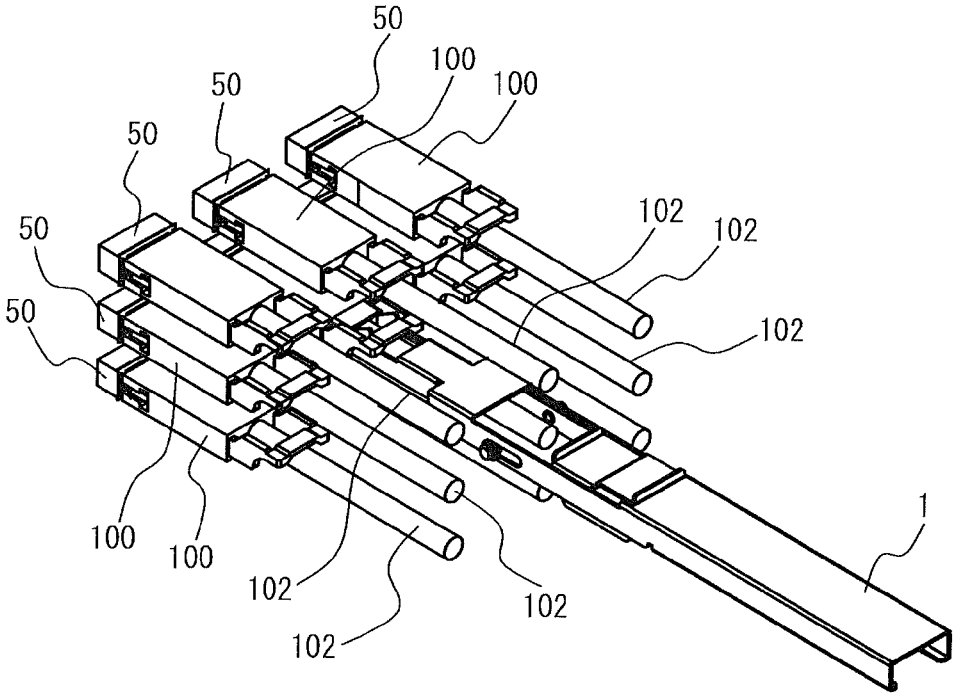
FIG. 13 is an explanatory diagram of the situation where the removing jig is used.

FIG. 13 is an explanatory diagram of the situation where the removing jig 1 is used under the condition where cable connectors 100 connected to substrate connectors 50 are densely located in the vertical direction and in the horizontal direction and cables 102 are closely spaced.

As the removing jig 1 includes the frame member 30 of which the length is long, it can reach the cable connector 100 to be removed even in the condition where cables 102 are closely spaced, and can remove the cable connector 100 from the substrate connector 50 easily.

As a result, it becomes unnecessary to secure the space for the work of removing the cable connector 100 to be removed, and it becomes possible to increase the speed for work. In addition, as it is not necessary to remove extra cable connectors 100, the risk for mistaking the locations where the cable connectors 100 are inserted is low when recovering the original state.

Moreover, as the removing jig 1 can propagate the force to the lever portion 103 efficiently and can pull the lever portion 103, it is possible to remove the cable connector 100 easily.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A connector removing jig for removing a cable connector from a substrate connector connected to the cable connector, the substrate connector including a first connecting terminal, a first engaging catch portion, and a second engaging catch portion, and the cable connector including a connector body to which a second connecting terminal to be connected to the first connecting terminal is provided on its front side, a lever portion located on a back side of the connector body so as to be reciprocally movable in a direction of removing the cable connector from the substrate connector, and a first engagement nail and a second engagement nail that engage with the first engaging catch portion and the second engaging catch portion respectively in conjunction with the lever portion, the connector removing jig comprising:

an arm member that includes a pair of side plates each provided with an axial hole, and an engagement portion that engages with the lever portion at its tip;

a frame member that includes a contact portion that contacts with a back surface of the connector body, a pair of side frame plates each provided with a guide groove formed with respect to the axial hole, and a first window portion from which the engagement portion protrudes; and a pair of connecting members each of which is inserted through the corresponding axial hole and the corresponding guide groove and connects the arm member swingably and slidably to the frame member.

2. The connector removing jig according to claim 1, wherein the guide grooves are formed as grooves that extend in a removable direction in which the cable connector is removed from the substrate connector, and the arm member is reciprocally movable in a longitudinal direction of the guide grooves against the frame member.

3. The connector removing jig according to claim 1, wherein the lever portion includes a pair of leg portions each extends in the removal direction and a bridging portion that connects the leg portions to form a space for housing the contact portion and that engages with the engagement portion of the arm member, and the contact portion is inserted into the space formed by the leg portions and the bridging portion.

4. The connector removing jig according to claim 3, wherein the contact portion is inserted into the formed space and contacts with the back surface of the connector body in a first state, and the engagement portion engages with the bridging portion in a second state where an amount of protrusion of the engagement portion from the first window portion is larger than in the first state.

5. The connector removing jig according to claim 1, wherein the arm member further includes a first arm operation portion formed in a shape of stairs in its base end, and the frame member further includes a second window portion from which the first arm operation portion protrudes by a swing of the arm member.

6. The connector removing jig according to claim 5, wherein the arm member further includes a second arm operation portion that is protruded from a bottom edge of the frame member therebeneath.

7. The connector removing jig according to claim 1, wherein each of the connecting members includes a screw part and a screw clamp part.

8. The connector removing jig according to claim 1, wherein the arm member and the frame member are formed of sheet metals.

9. A connector removing method for removing a cable connector from a substrate connector connected to the cable connector, the substrate connector including a first connecting terminal, a first engaging catch portion and a second engaging catch portion, and the cable connector including a connector body to which a second connecting terminal to be connected to the first connecting terminal is provided on its front side, a lever portion located on a back side of the connector body so as to be reciprocally movable in a direction of removing the cable connector from the substrate connector, and a first engagement nail and a second engagement nail that engage with the first engaging catch portion and the second engaging catch portion respectively in conjunction with the lever portion, the connector removing method comprising:

making a state of an engagement portion in a first state where an amount of protrusion from a first window portion is small;

moving a frame member forward with keeping the state of the engagement portion in the first state, and making a contact portion contact with a back surface of the connector body;

making the state of the engagement portion in a second state where an amount of protrusion from the first window portion is larger than in the first state by swinging an arm member with keeping the contact portion contact with the back surface of the connector body, and engaging the engagement portion with a lever portion;

moving the member backward against the frame member in a condition where the engagement portion is engaged with the lever portion, releasing an engagement between the first engagement nail and the first engaging catch portion, and releasing an engagement between the second engagement nail and the second engaging catch portion; and moving the frame member backward in a condition where the engagement between the first engagement nail and the first engaging catch portion is released and the engagement between the second engagement nail and the second engaging catch portion is released, and releasing the connection between the first connecting terminal and the second connecting terminal.

* * * * *

UNITED STATES PATENT AND TRADEMARK OFFICE

CERTIFICATE OF CORRECTION

PATENT NO. : 8,863,376 B2
APPLICATION NO. : 13/093051
DATED : October 21, 2014
INVENTOR(S) : Masayoshi Hirano et al.

It is certified that error appears in the above-identified patent and that said Letters Patent is hereby corrected as shown below:

In the Claims

Column 10, Line 20, In claim 9, after "the" insert -- arm --.

Signed and Sealed this
Thirty-first Day of March, 2015

Michelle K. Lee

Michelle K. Lee
*Director of the United States Patent and Trademark Office*